US011279130B2

(12) United States Patent
Cumbie et al.

(10) Patent No.: US 11,279,130 B2
(45) Date of Patent: Mar. 22, 2022

(54) FLUIDIC DIES WITH CONDUCTIVE MEMBERS

(71) Applicant: Hewlett-Packard Development Company, L.P., Fort Collins, CO (US)

(72) Inventors: Michael W Cumbie, Albany, OR (US); David J Benson, Corvallis, OR (US); Randy Hoffman, Corvallis, OR (US); Amy Gault, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/958,578

(22) PCT Filed: Apr. 29, 2019

(86) PCT No.: PCT/US2019/029714
§ 371 (c)(1),
(2) Date: Jun. 26, 2020

(87) PCT Pub. No.: WO2020/222766
PCT Pub. Date: Nov. 5, 2020

(65) Prior Publication Data

US 2021/0229440 A1 Jul. 29, 2021

(51) Int. Cl.
*B41J 2/14* (2006.01)
*B41J 2/16* (2006.01)

(52) U.S. Cl.
CPC ..... *B41J 2/14145* (2013.01)

(58) Field of Classification Search
CPC .. B41J 2/14145; B41J 2/1415; B41J 2/14072; B41J 2/1637
See application file for complete search history.

(56) References Cited

U.S. PATENT DOCUMENTS

| | | | |
|---|---|---|---|
| 5,790,154 | A | 8/1998 | Mitani et al. |
| 6,188,414 | B1 | 2/2001 | Wong et al. |
| 6,350,017 | B1 | 2/2002 | Kamada et al. |
| 7,103,972 | B2 | 9/2006 | Chen et al. |
| 8,359,747 | B2 | 1/2013 | Matsuzawa |
| 8,425,028 | B2 | 4/2013 | Yue et al. |
| 9,061,494 | B2 | 6/2015 | Rogers et al. |
| 2006/0081178 | A1 | 4/2006 | Willey |
| 2006/0252111 | A1 | 11/2006 | Tyvoll |
| 2007/0151942 | A1 | 7/2007 | Dishongh |

(Continued)

FOREIGN PATENT DOCUMENTS

| | | | |
|---|---|---|---|
| CN | 102470672 | A | 5/2012 |
| EP | 3332967 | A1 | 6/2018 |

(Continued)

*Primary Examiner* — Jason S Uhlenhake
(74) *Attorney, Agent, or Firm* — Austin Rapp

(57) ABSTRACT

Examples include a fluidic device comprising a fluidic die, a support element, and a conductive member. The support element is coupled to the fluidic die, and the support element has a fluid channel formed therein. The fluid channel exposes at least a portion of a back surface of the fluidic die. The support element further includes a member opening passing therethrough. The conductive member is connected to the fluidic die, and the conductive member is a least partially disposed in the member opening such that a portion of the conductive member is exposed to the fluid channel of the support element.

15 Claims, 9 Drawing Sheets

(56) References Cited

U.S. PATENT DOCUMENTS

| | | | | |
|---|---|---|---|---|
| 2012/0056943 | A1* | 3/2012 | Nielsen | B41J 2/14153 347/63 |
| 2014/0118441 | A1 | 5/2014 | Lambright et al. | |
| 2016/0236468 | A1* | 8/2016 | Chng | B41J 2/1637 |
| 2017/0087842 | A1 | 3/2017 | Koide | |
| 2017/0239965 | A1 | 8/2017 | Chng et al. | |
| 2017/0291417 | A1 | 10/2017 | Okubo et al. | |

FOREIGN PATENT DOCUMENTS

| | | | |
|---|---|---|---|
| JP | 2001162803 | | 6/2001 |
| TW | 201630754 | A | 9/2016 |
| WO | WO-2007098527 | | 9/2007 |
| WO | WO-2010044773 | A1 | 4/2010 |

* cited by examiner

FLUIDIC DIES WITH CONDUCTIVE MEMBERS

BACKGROUND

Microfluidic devices may correspond to various microelectromechanical systems which convey, dispense, and/or process small volumes (e.g., microliters) of fluids. Some example microfluidic devices include fluidic dies, fluid sensors, and/or other similar devices. As a further example of a fluidic die, printheads are devices configured to controllably dispense fluid drops.

DRAWINGS

FIGS. 1A-B are block diagrams that illustrate some components of an example fluid ejection device.

FIGS. 2A-B are different views that illustrate some components of an example fluid ejection device.

Figure 6A:
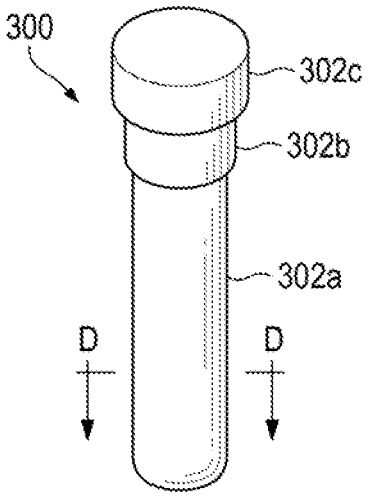
Figure 6B:
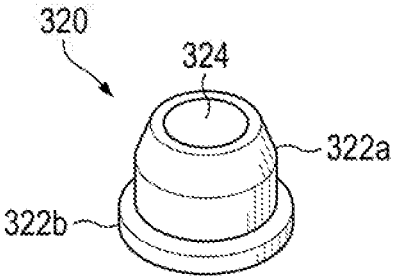
Figure 6C:
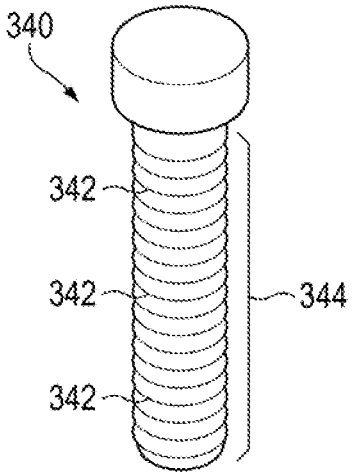

FIGS. 6A-C are isometric views of example conductive members that may be implemented in fluid ejection devices described herein.

Figure 6D:
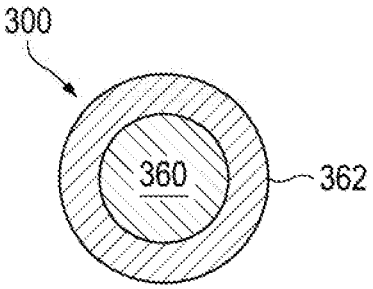

FIG. 6D is a cross-sectional view of the example conductive member of FIG. 6A.

Figure 7:
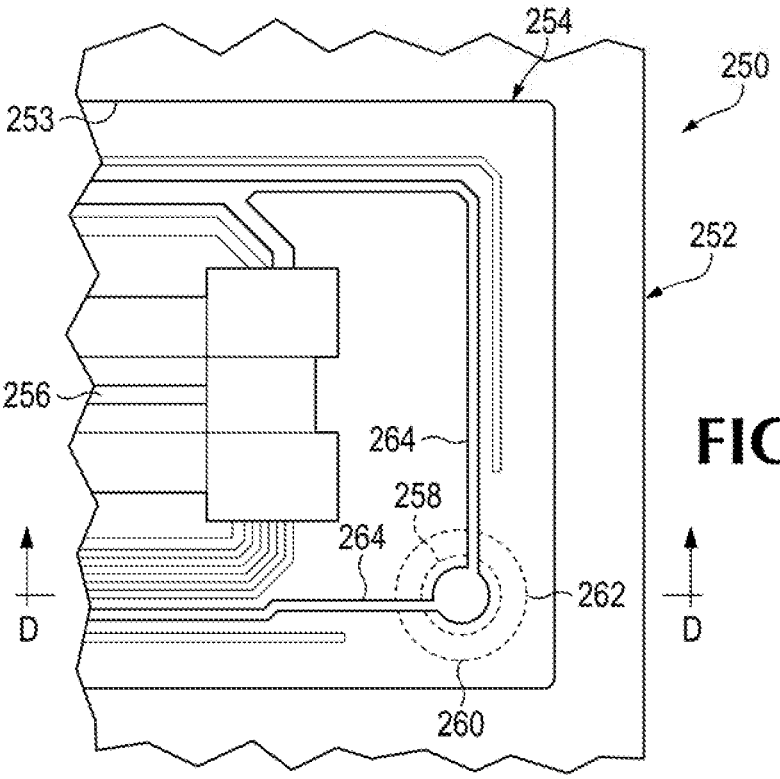

FIG. 7 is a top isometric view of some components of an example fluid ejection device.

Figure 8:
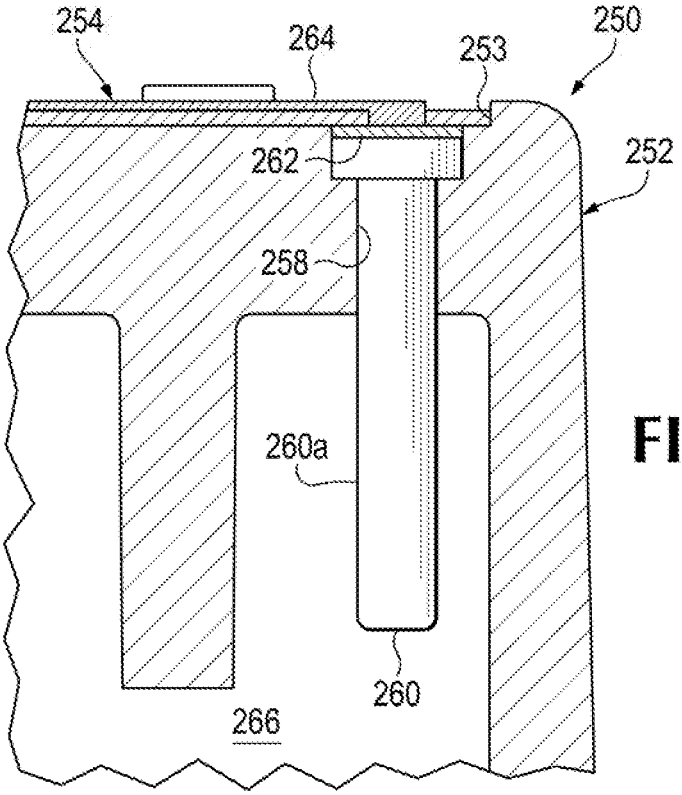

FIG. 8 is a cross-sectional view of some components of an example fluid ejection device.

Figure 9:
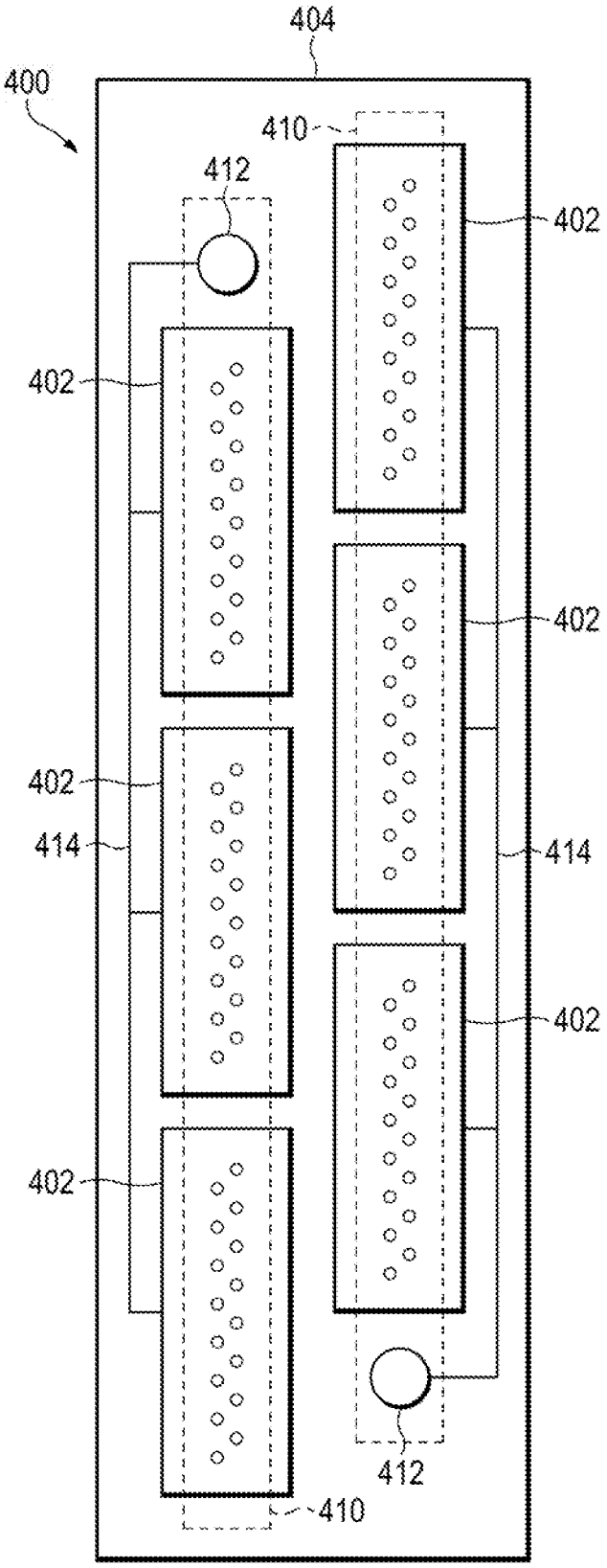

FIG. 9 is a top view of some components of an example fluid ejection device.

Figure 10:
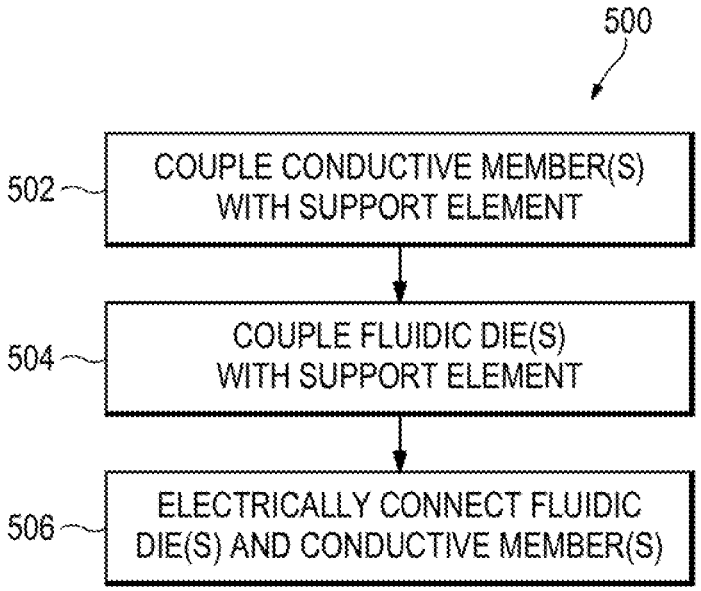

FIG. 10 is a flowchart that illustrates operations of an example process.

Throughout the drawings, identical reference numbers designate similar, but not necessarily identical, elements. The figures are not necessarily to scale, and the size of some parts may be exaggerated to more dearly illustrate the example shown. Moreover, the drawings provide examples and/or implementations consistent with the description; however, the description is not limited to the examples and/or implementations provided in the drawings.

DESCRIPTION

Examples of fluid ejection devices may comprise a support element, at least one fluidic die, and at least one conductive member. The at least fluidic die is coupled to the support element. The support element may have a fluid channel formed therein, where the fluid channel may expose at least a portion of a back surface of the fluidic die. In some examples, the fluidic die may comprise fluid ports formed through the back surface of the fluidic die and fluidically coupled to the fluid channel of the support element. In some examples, the fluidic die may include at least one sensor element disposed on the back surface of the fluidic die and exposed to the fluid channel. In some examples, the sensor element may comprise an electrode that may be exposed to fluid contacting a back surface of the die. In addition, the support element may include a member opening that passes through the support element. The conductive member may be engaged with and pass through the member opening of the support element such that at least a portion of the conductive member is exposed to the fluid channel. Furthermore, the conductive member may be connected to the fluidic die.

In some examples, the fluidic die may be coupled to the support element via adhesive. In some examples, the fluidic die may be at least partially embedded in material of the support element. For example, the support element may comprise an epoxy mold compound, and the fluidic die may be at least partially molded in the support element. In other examples, the at least one fluidic die may be coupled to a secondary support element, which may be referred to as a "chiclet," and the chiclet may be coupled to the support element in a recess of the support element. In some examples, a chiclet and/or support element may be formed by a molding process. In other examples, a chiclet and/or support element may be formed by an encapsulation process. In other examples, a chiclet and/or support element may be formed by other machining processes such as cutting, grinding, bonding, etc.

In some examples, the fluidic die may correspond to a fluid ejection die. In such examples, a fluid ejection die may comprise a plurality of nozzles, where the nozzles may be used to selectively dispense fluid drops. In further examples comprising nozzles, the fluid ejection die may correspond to a printhead that may selectively dispense printing material by ejecting fluid drops of the printing material via the nozzles. A top surface of a fluid ejection die may include nozzle orifices formed therein, and a nozzle layer of the fluid ejection die may include the nozzles formed therethrough and terminating at the nozzle orifices on the top surface. The nozzles of a fluid ejection die may be fluidically coupled to a fluid chamber, where the fluid chambers may be formed in a chamber layer of the fluid ejection die that is adjacent to the nozzle layer. A fluid actuator may be disposed in each fluid chamber, and actuation of a respective fluid actuator may cause displacement of fluid in a respective fluid chamber in which the fluid actuator is positioned. Displacement of the fluid in the respective fluid chamber in turn may cause ejection of a fluid drop through a respective nozzle fluidically coupled to the respective fluid chamber. To supply fluid to the fluid chambers, the fluid chambers may be fluidically coupled to fluid ports formed through a back surface of the fluid ejection die.

Some examples of types of fluid actuators implemented in fluid ejection devices include thermal ejectors, piezoelectric ejectors, and/or other such ejectors that may cause fluid drops to eject/be dispensed from a nozzle orifice. In some examples the fluid ejection dies may be formed with silicon or a silicon-based material. Various features, such as nozzles, fluid chambers, and fluid passages may be formed from various materials and processes used in silicon device-based fabrication, such as silicon dioxide, silicon nitride, metals, epoxy, polyimide, other carbon-based materials, etc. Where such fluidic features may be formed by various microfabrication processes, such as etching, deposition, photolithography, bonding, cutting, and/or other such microfabrication processes.

In some examples, fluid ejection dies may be referred to as slivers. Generally, a sliver may correspond to a fluid ejection die having: a thickness of approximately 650 μm or less; exterior dimensions of approximately 30 mm or less; and/or a length to width ratio of approximately 3 to 1 or larger. In some examples, a length to width ratio of a sliver may be approximately 10 to 1 or larger. In some examples, a length to width ratio of a sliver may be approximately 50 to 1 or larger. In some examples, fluid ejection dies may be a non-rectangular shape. In these examples a first portion of the fluid ejection die may have dimensions/features approximating the examples described above, and a second portion of the fluid ejection die may be greater in width and less in length than the first portion. In some examples, a width of the second portion may be approximately 2 times the size of the width of the first portion. In these examples, a fluid ejection die may have an elongate first portion along which nozzles may be arranged, and the fluid ejection die may have a second portion upon which electrical connection points for the fluid ejection die may be arranged.

In some examples, a support element may be formed of a single material, i.e., the support element may be uniform. Furthermore, in some examples, a support element may be a single piece, i.e., the support element may be monolithic. In some examples, a support element and/or a chiclet may comprise an epoxy mold compound, such as CEL400ZHF40WG from Hitachi Chemical, Inc., and/or other such materials. In another example, the support element and/or chiclet may comprise thermal plastic materials such as PET, PPS, LCP, PSU, PEEK, and/or other such materials. Accordingly, in some examples, the support element and/or chiclet may be substantially uniform. In some examples, the support element and/or chiclet may be formed of a single piece, such that the support element and/or chiclet may comprise a mold material without joints or seams. As used herein, a molded support element and/or molded chiclet may not refer to a process in which the carrier and/or chiclet may be formed; rather, a molded support element and/or molded chiclet may refer to the material from which the carrier and/or chiclet may be formed.

Example fluidic devices, as described herein, may be implemented in printing devices, such as two-dimensional printers and/or three-dimensional printers (3D). As will be appreciated, some example fluidic devices may be printheads. In some examples, a fluidic device may be implemented into a printing device and may be utilized to print content onto a media, such as paper, a layer of powder-based build material, reactive devices (such as lab-on-a-chip devices), etc. Example fluidic devices include ink-based ejection devices, digital titration devices, 3D printing devices, pharmaceutical dispensation devices, lab-on-chip devices, fluidic diagnostic circuits, and/or other such devices in which amounts of fluids may be dispensed/ejected.

In some examples, a printing device in which a fluid ejection device may be implemented may print content by deposition of consumable fluids in a layer-wise additive manufacturing process. Consumable fluids and/or consumable materials may include all materials and/or compounds used, including, for example, ink, toner, fluids or powders, or other raw material for printing. Furthermore, printing material, as described herein may comprise consumable fluids as well as other consumable materials. Printing material may comprise ink, toner, fluids, powders, colorants, varnishes, finishes, gloss enhancers, binders, fusing agents, inhibiting agents, and/or other such materials that may be utilized in a printing process.

Figure 1A:
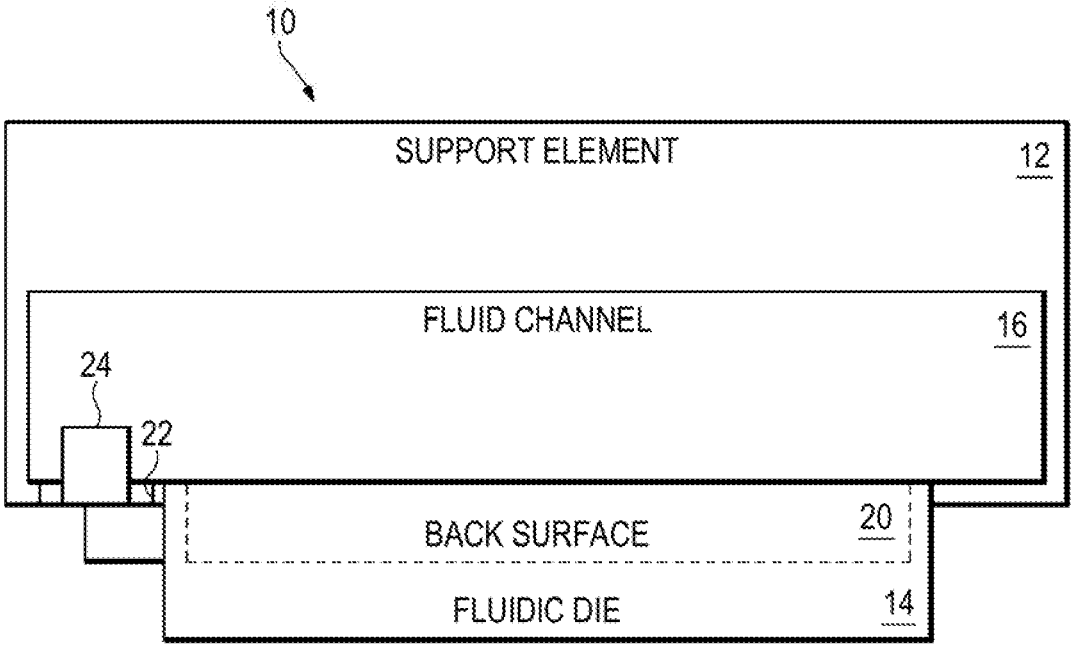
Figure 1B:
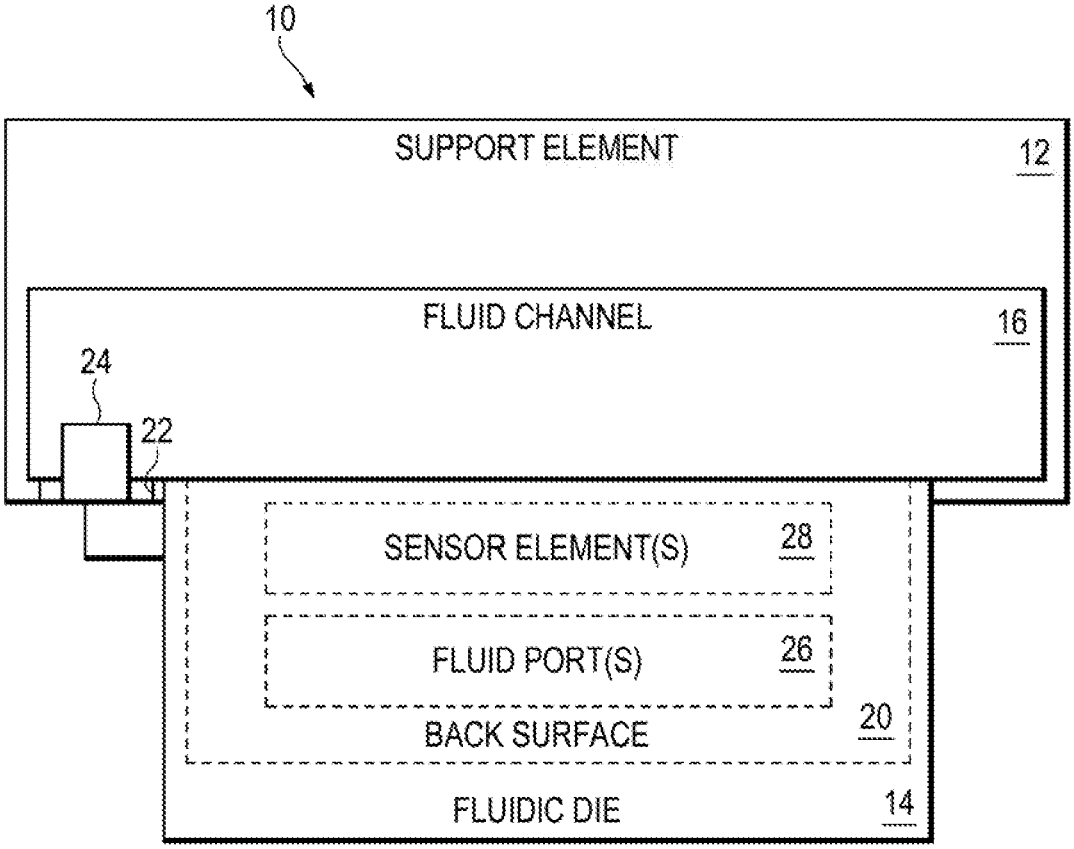

Turning now to the figures, and particularly to FIGS. 1A-B, these figures provide block diagrams that illustrate some components of an example fluidic device 10. In this example, the fluidic device 10 comprises a support element 12 and a fluidic die 14 coupled to the support element 12. As shown, the support element 12 includes a fluid channel 16 formed therein. The fluidic die 14 is coupled to the support element such that at least a portion of a back surface 20 of the fluidic die 14 is exposed to the fluid channel 16 of the support element 12. The support element further includes a member opening 22 formed therethrough. As shown in the example, the member opening 22 is formed such that the opening is proximate the fluid channel 16. The device 10 includes a conductive member 24 that is engaged with and passes through the member opening 22 of the support element 12. As shown, a portion of the conductive member 24 is exposed to and disposed in the fluid channel 16. Furthermore, the conductive member 24 is connected to the fluidic die 14.

In FIG. 18, the example fluidic device 10 further comprises a plurality of fluid ports 26 formed in the back surface 20 of the fluidic die 14. Accordingly, in this example, the fluidic ports 26 may be fluidically coupled to the fluid channel 16 of the support element 12 such that fluid may be conveyed from the fluid channel 16 to the fluid ports 26. Moreover, FIG. 1B further illustrates the example fluidic die 14 including at least one sensor element 28 disposed and/or formed on the back surface 20 of the fluidic die such that the sensor element 28 may be exposed to the fluid channel 16. The at least one sensor 28 and the fluid ports 26 are illustrated in dashed line to show that one or both of these components are may be included in some implementations.

Figure 2A:
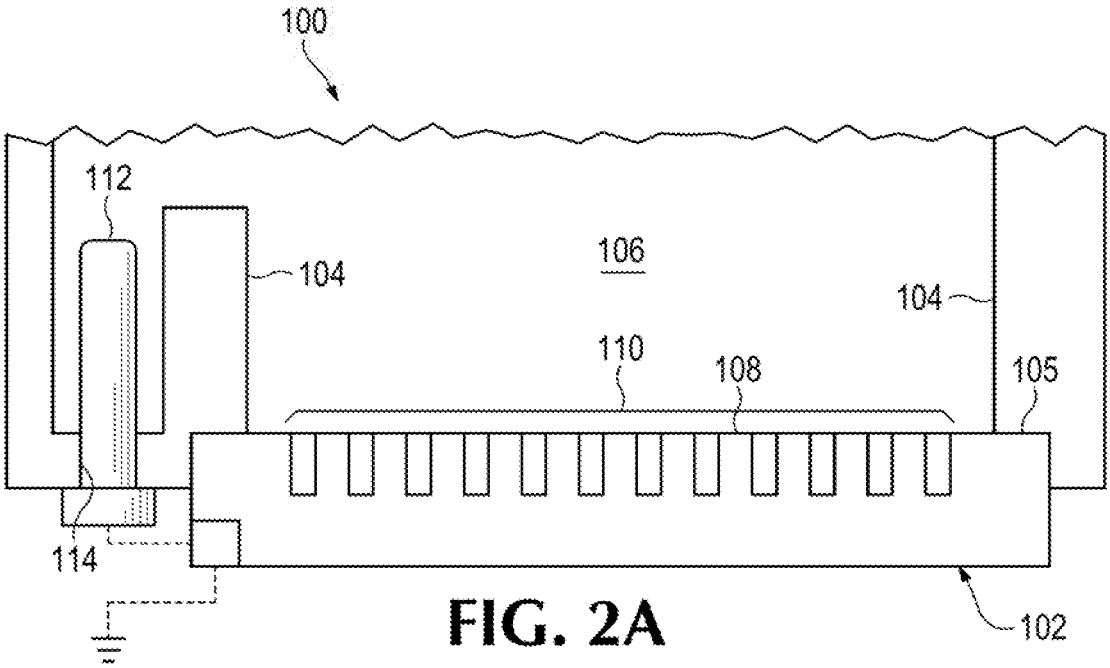
Figure 2B:
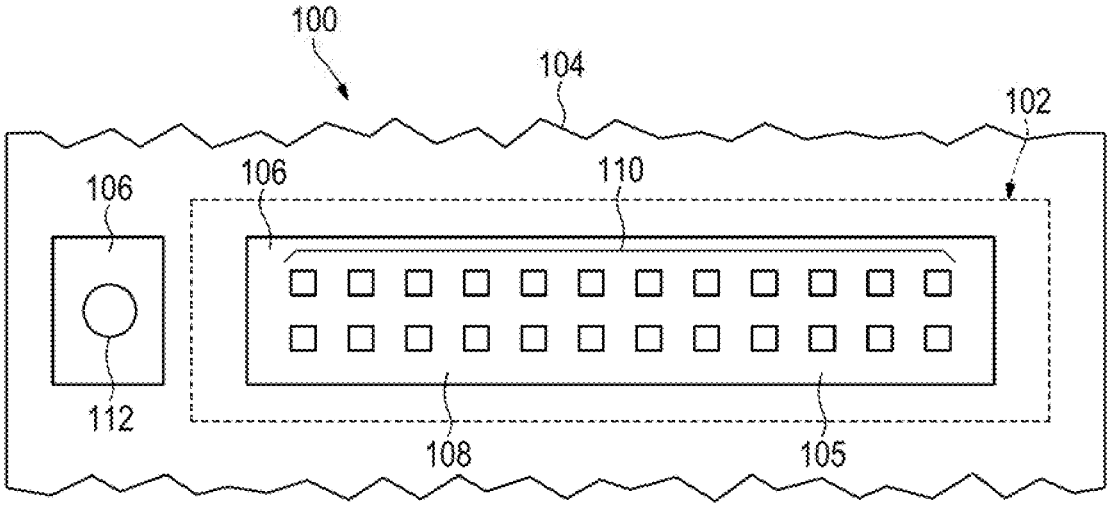

FIG. 2A provides a cross-sectional view of some components of an example fluidic device 100, and FIG. 2B provides a top view of some of the components of the device 100. As shown, a fluidic die 102 may be coupled to a support element 104. Notably, the perimeter of the fluidic die 102 is illustrated in dashed line in FIG. 2B to illustrate that at least a portion of a back surface 105 of the fluidic die 102 may be covered by the support element 104. The support element 104 includes a fluid channel 106 formed therein. As shown, the channel 106 exposes at least a portion 108 of the back surface 105 of the fluidic die 102. On the exposed portion 108 of the back surface 105 of the fluidic die 102, fluid ports 110 may be formed therethrough such that the fluid channel 106 of the support element 104 may be fluidically coupled to the fluid ports 110 of the fluidic die 102.

Furthermore, the device 100 may include a conductive element 112 that is electrically connected to the fluidic die 102. The conductive member may pass through a member opening 114 such that a portion of the conductive member 112 may be exposed to the fluid channel 106. As shown in this example, a substrate of the fluidic die 102 and the conductive member 112 may be connected to an electrical ground connection. Accordingly, when the channel 106 of the fluidic device 100 includes fluid therein, and the device 100 is electrically connected, an electrochemical cell may be formed by the conductive member 112 and the substrate of the fluidic die 102.

In some examples, coupling the conductive member 112 and the fluidic die 102 together may facilitate an electrochemical cell when in contact with fluid of the fluid channel. In some examples, a substrate of the fluidic die 102 may be silicon. In some examples, the electrochemical cell formed between the exposed portion of the conductive member 112 and the exposed portion 108 of the fluidic die 102 may reduce etching of the exposed portion 108 of the fluidic die 102 due to the galvanic effect between the conductive member 112 and the fluidic die 102 in which fluid of the fluid channel acts as an electrolyte. In such examples, etching of surfaces of the fluidic die 102 exposed to a fluid may be reduced including surfaces of fluid ports, surfaces of fluid chambers, and/or the back surface of the fluidic die 102. In some examples, the fluid may have a pH level greater than approximately 7. In some examples, the fluid may have a pH level greater than approximately 8. In some examples, the fluid may have a pH level within a range of approximately 7 to approximately 9. In such examples, the conductive member may comprise gold, tantalum, gold plating, and/or tantalum plating.

Furthermore, in some examples, a surface area of the conductive member 112 exposed to the fluid channel 106 may be greater than a surface area of the fluidic die 102 exposed to the fluid channel 106. For example, the surface area of the fluidic die 102 exposed to the fluid channel may be a first surface area, and the surface are of the conductive member 112 exposed to the fluid channel may be a second surface area. In some examples, the second surface area may be greater than the first surface area. In other examples, the second surface area may be less than the first surface area. In other examples, the first surface area and the second surface area may be approximately equal. In some examples, a ratio of the second surface area to the first surface area may be in a range of approximately 1:1 to approximately 5:1. In some examples, the ratio of the second surface area to the first surface area may be approximately 3:1. In some examples, the ratio of the second surface area to the first surface area may be approximately 2.5:1 to approximately 3.5:1. In some examples, the ratio between the second surface area and the first surface area may be greater than approximately 5:1. In some examples, the ratio between the second surface area and the first surface area may be less than approximately 1:1 (e.g., 0.9:1, 0.8:1, 0.5:1, etc.).

Figure 3:
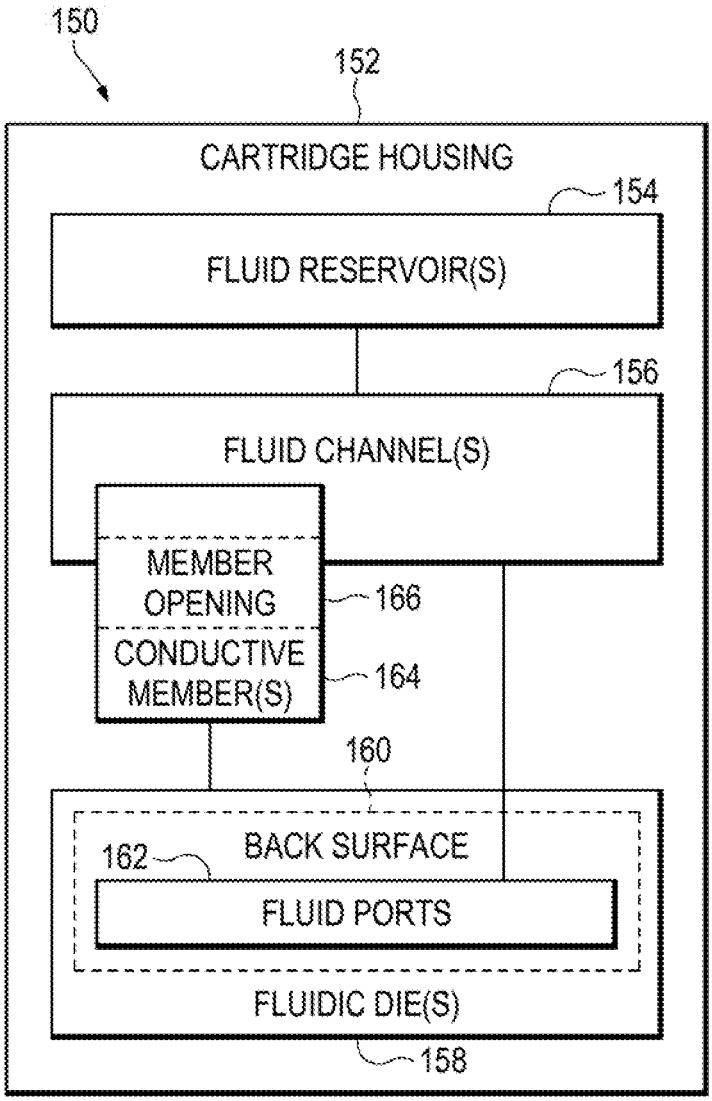
FIG. 3 is block diagram that illustrates some components of an example fluid ejection device.

FIG. 3 provides a block diagram that illustrates some components of an example fluidic device 150. In this example, the fluidic device 150 comprises a support element in the form of a cartridge housing 152. The cartridge housing 152 includes at least one fluid reservoir 154 formed therein, and the cartridge housing 152 further comprises, for each fluid reservoir 154, at least one fluid channel 156 formed therein.

Furthermore, the device 150 includes at least one fluidic die 158 coupled to the housing 152. A back surface 160 of the at least one fluidic die 158 includes fluid ports 162 formed therein. Similar to other examples, at least a portion of the back surface 160 of each fluidic die 158 is exposed to a fluid channel 156 that is formed in the support element, which in this example corresponds to the cartridge housing 152. In this example, the fluid ports 162 are fluidically coupled to a respective fluid channel 156, and the fluid channel 156 is fluidically coupled to a respective fluid reservoir 154. Accordingly, fluid may be conveyed from the fluid reservoir 154 to the fluid ports 162 of the fluidic die 158 via the fluid channel 156.

In this example, the device 150 includes at least one conductive member 164 that is engaged with and passes through a member opening 166 such that at least a portion of the conductive member 164 is exposed to the fluid channel 156. As shown, the conductive member 164 is electrically connected to the at least one fluidic die 158. As discussed in other examples, the conductive member 164 and fluidic die 158 may be electrically connected to a common ground. By electrically grounding the conductive member 164 and the fluidic die 158, an electrochemical cell may be formed therebetween when the conductive member 164 and fluidic die 158 are in contact with fluid of the fluid channel 156. In such examples, the electrochemical cell formed with the conductive member 164, the fluidic die 158, and fluid of the fluid channel 156 may reduce and/or prevent etching of surfaces of the fluidic die 158 by fluid in contact therewith.

Figure 4:
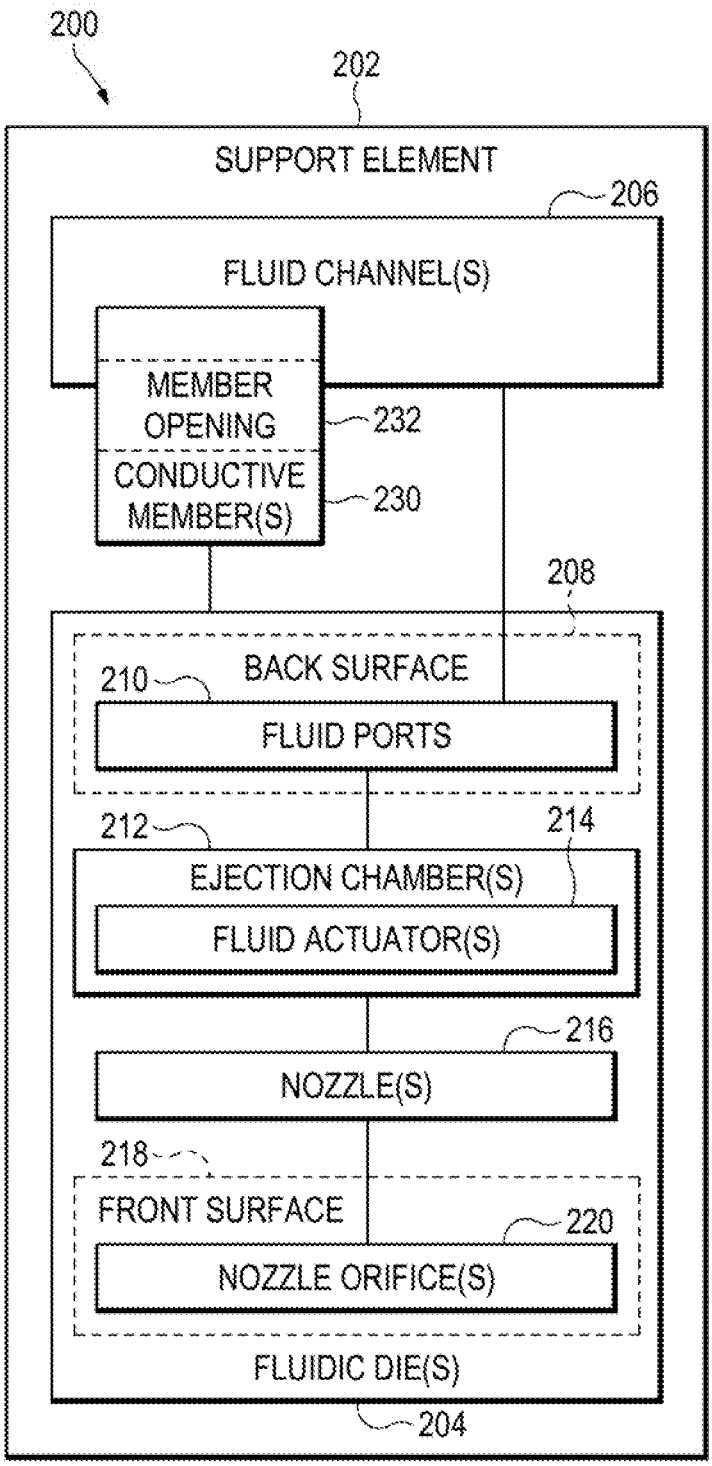
FIG. 4 is a block diagram that illustrates some components of an example fluid ejection device.

Turning now to FIG. 4, this figure provides a block diagram that illustrates some components of an example fluidic device 200. The fluidic device 200 includes a support element 202 that is coupled with at least one fluidic die 204. The support element 202 includes at least one fluid channel 206 formed therein. A back surface 208 of the at least one fluidic die 204 includes fluid ports 210 formed therein. Similar to other examples, at least a portion of the back surface 208 of each fluidic die 204 is exposed to a respective fluid channel 206. In this example, the fluid ports 210 are fluidically coupled to the respective fluid channel 206, and the fluid channel 206. Accordingly, fluid may be conveyed from to the fluid ports 210 of the fluidic die 204 via the fluid channel 206.

In addition, each fluidic die 204 further includes ejection chambers 212 that are fluidically coupled to the fluid ports 210. Disposed in each ejection chamber 212, the fluidic die 204 includes a fluid actuator 214. Each ejection chamber 212 is fluidically coupled to a respective nozzle 216. Each nozzle 216 extends through a layer of the fluidic die 204 and terminates on a front surface 218 of the fluidic die 204 at a nozzle orifice 220. In examples similar to the example of FIG. 4, the fluidic device 200 may correspond to a fluid ejection device. In such examples, fluid drops may be controllably dispensed through the nozzles 216 thereof by actuation of the fluid actuators 214. Some examples of fluid ejection devices may include printheads, digital titration devices, and/or other such microfluidic devices that controllably dispense small volumes (e.g., picoliter scale, microliter scale, etc.) of fluid.

Furthermore, in this example, the device 200 includes at least one conductive member 230 that is engaged with and passes through a member opening 232 of the support element 202 such that at least a portion of the conductive member 230 is exposed to the fluid channel 206. As shown, the conductive member 230 is electrically connected to the at least one fluidic die 204. As discussed in other examples, the conductive member 230 and fluidic die 204 may be electrically connected to a common ground. By electrically grounding the conductive member 230 and the fluidic die 204, an electrochemical cell may be formed therebetween when the conductive member 230 and fluidic die 204 are in contact with fluid of the fluid channel 206.

Figure 5:
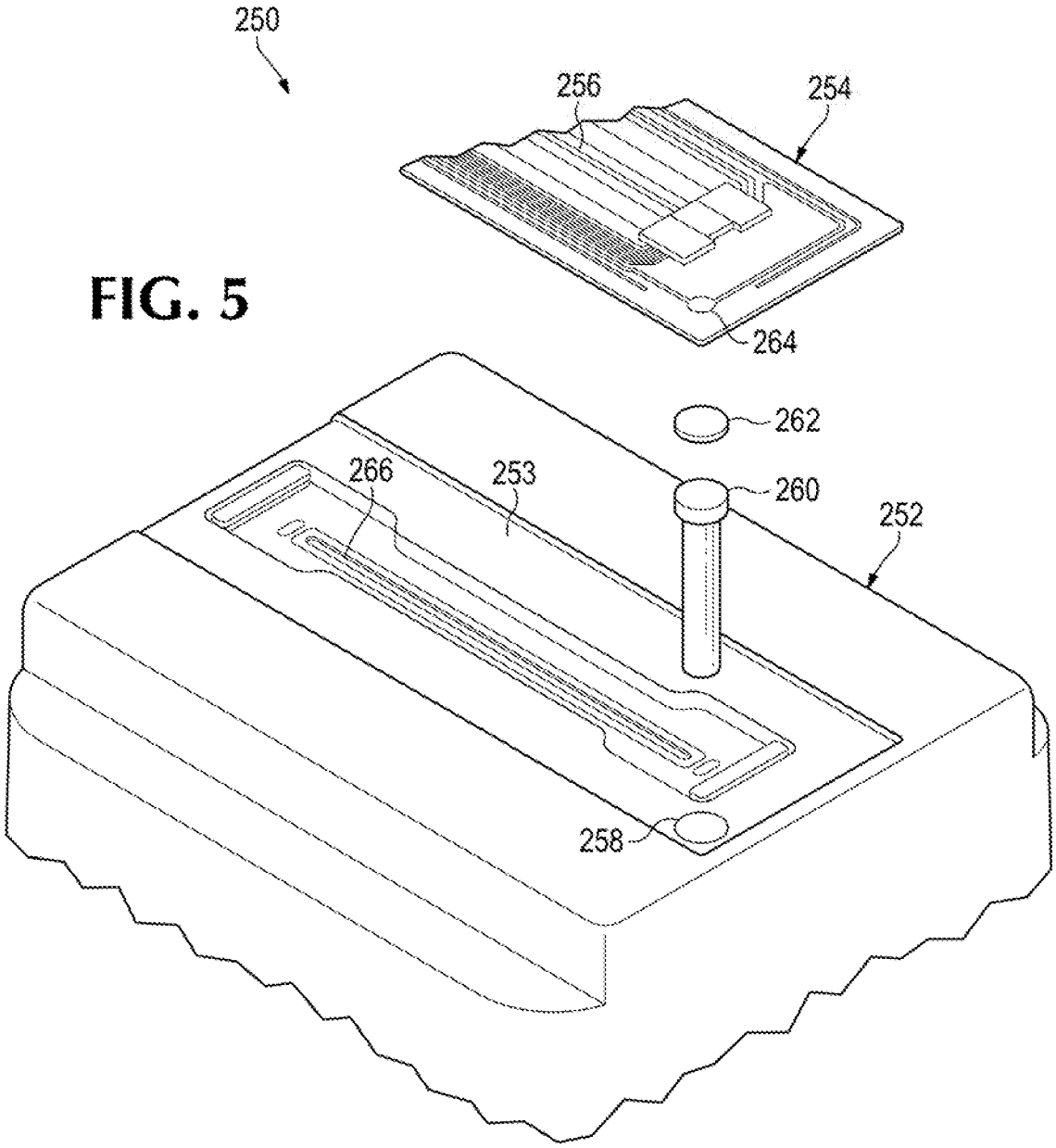
FIG. 5 is an exploded isometric view of an example fluid ejection device.

FIG. 5 provides an exploded isometric view of an example fluidic device 250. In this example, the fluidic device 250 includes a support element in the form of a cartridge housing 252. As shown, the cartridge housing may include a recessed portion 253 into which a fluidic die assembly 254 comprising at least one fluidic die 256 may be disposed. As shown, the fluidic device 250 may include a member opening 258 formed through the cartridge housing 252, and a conductive member 260 may be shaped such that it may be positioned in the member opening 258. A conductive adhesive 262 may be disposed between the conductive member 260 and the fluidic die assembly 254 such that the conductive adhesive 262 adheres the conductive member 260 to the cartridge housing 252 and connects the conductive member 260 to the fluidic die 256. In this example, the fluidic die assembly includes conductive traces 264 that contact with the conductive adhesive 262, and the conductive traces 264 facilitate electrical connection between the fluidic die 256 and the conductive member 260. In addition, as shown in this example, the cartridge housing 252 includes a fluid channel 266 formed through the cartridge housing 252 and positioned in the recessed portion 253. While not shown in this example, it may be appreciated that the fluid channel 266 is aligned with fluid ports of the fluidic die 256 when the fluidic die assembly 254 is positioned in the recessed portion 253.

FIGS. 6A-D provide views of various conductive members that may be implemented in examples. In FIG. 6A, the conductive member 300 corresponds to an elongated pin, with a cylindrical shape, having: a first portion 302*a* that may be sized to pass through a member opening; a second portion 302*b* that may engage a shoulder of the support element around the member opening; and a third portion 302*c* that may engage the support element and facilitate securing the conductive member 300 to a support element and electrically connecting to a fluidic die. In this example, the first portion 302*a* may correspond to a portion of the conductive member 300 that may be exposed to fluid a fluid channel of a fluidic device when engaged with and passing through a member opening. Accordingly, the first portion 302*a* may have a surface area that facilitates formation of an electrochemical cell as described herein. FIG. 6B illustrates an example conductive member 320. In this example, the conductive member 320 has a first portion 322*a* which may be sized to pass through a member opening of a support member as described herein. Furthermore, the first portion 322*a* may be exposed to a fluid channel when positioned in the member opening. In this example, the conductive member 320 may include an opening 324 formed in the first portion 322*a*. In examples similar to the example of FIG. 6B, the opening 324 may be formed such that the portion of the conductive member 320 to be exposed to a fluid channel may have a particular surface area, where the surface area may enable formation of an electrochemical cell as described herein. The conductive member 320 may further include a second portion 322*b* that may engage a portion of a support member proximate the member opening to facilitate securing the conductive member 320 to the support element. In FIG. 6C, the conductive member 340 includes one or more ribs or protrusions 342 on a first portion 344 of the conductive member 340. Similar to other examples, the size and number of ribs or protrusions may correspond to a surface area of the conductive member to be exposed to a fluid channel.

In FIG. 6D, a cross-sectional view along line D-D of the conductive member 300 of FIG. 6A. In some examples, a conductive member may be formed of more than one material. In the example of FIG. 61, the conductive member may have a core 360 formed of a first material that is at least partially enclosed by a layer 362 of a second material. Examples of conductive members may be at least partially formed of gold, gold alloys, nickel, nickel alloys, tantalum, tantalum alloys, aluminum, aluminum alloys, stainless steel, various plastics, or any combination thereof. In one example, a core of a conductive member may be formed of a nickel alloy that is plated with an outer gold layer. In another example, a core of a conductive member may be stainless steel, the stainless-steel core may be plated with a layer of nickel and then a layer of gold. In another example, the conductive member may include a core formed of plastic, and the core may be plated with a layer of nickel then with a layer of gold. Other examples may include various combinations of various example materials that facilitate electrical conductance.

FIG. 7 provides a top isometric view of the fluidic device 250 of FIG. 5. FIG. 8 provides a cross-sectional view along view line E-E of FIG. 7. As shown in these views, the fluidic die assembly 254 may be disposed in the recessed portion 253 of the cartridge housing 252 such that the fluid ports (not shown) on a back surface of the fluidic die 256 may be aligned with and fluidically coupled to the fluid channel 266 (shown in FIGS. 5 and 8) of the cartridge housing 252. Furthermore, the views in FIGS. 7-8 illustrate the alignment of the conductive member 260 in the member opening 258. As discussed, the conductive adhesive 262 may be disposed on the conductive member 260, and the conductive adhesive 262 may engage with and electrically connect to the conductive member 260 and conductive traces 264 of the fluidic die assembly 254 to thereby electrically connect the conductive member 260 and the fluidic die 256. As shown in FIG. 8, at least a portion 260*a* of the conductive member 260 may be exposed to the fluid channel 268.

FIG. 9 provides a block diagram that illustrates an example fluidic device 400. In this example, the fluidic device 400 includes a plurality of fluidic dies 402 coupled to a support element 404. In this example, the fluidic dies include nozzles having nozzle orifices 406 formed on a front surface 408 thereof. While not shown but as described in previous examples, each nozzle may be fluidically coupled to an ejection chamber, and each ejection chamber may be fluidically coupled to a fluid port formed in a back surface (i.e., a surface opposite the front surface 408). Furthermore, it may be noted that, in this example, the plurality of fluidic dies 402 are generally arranged in a staggered and overlapping manner along a width of the support element 404.

The support element 404 includes fluid channels 410 formed therein. The fluid channels 410 are illustrated in dashed line to indicate that the channels are formed through a back surface of the support element 404. As shown, the fluidic dies 402 are aligned with one of the fluid channels 410 such that at least a portion of a back surface of each die 402 is exposed to the aligned fluidic channel 410. Accordingly, the fluid ports formed on the back surfaces of the fluidic dies 402 are fluidically coupled to the aligned fluid channels 410. In addition, the fluidic device 400 includes conductive members 412. Similar to previous examples, each conductive member 412 may be aligned with a fluid channel 410 and positioned in a member opening of the support element 404 such that at least a portion of the conductive member 412 is exposed to the fluid channel 410. In addition, each conductive member 412 may be electrically connected to some of the plurality of fluidic dies 402 via conductive traces 414.

FIG. 10 provides a flowchart 500 that illustrates example operations of a process that may be performed to form a fluidic device as described herein. As shown, at least one conductive member may be coupled to a support element (block 502). As shown in some examples provided herein, the at least a portion of the conductive member may be pass through a member opening formed in the support element, and a portion of the conductive member may engage with and be positioned proximate a surface of the support element. In some examples, the conductive member may be press fit into the member opening of the support element. In some examples, the conductive member may be insert molded into the member opening of the support element. At least one fluidic die may be coupled to the support element (block 504). As described in other examples, a fluidic die may be coupled to a support element via adhesive, molding, and/or other such coupling processes. In some examples, coupling the at least one fluidic die to the support element may comprise coupling a fluidic die assembly that includes the at least one fluidic die to the support element. The at least one fluidic die and the at least one conductive member may be electrically connected (block 506). As illustrated in some examples provided herein, fluidic dies and conductive members may be electrically connected via conductive traces. In some examples, a conductive adhesive may be disposed between an electrical contact of a fluidic die and the conductive member. In other examples, the conductive member may be electrically connected to the fluidic die with a soldered conductive trace or a wire bond.

Accordingly, examples provided herein may provide fluid ejection devices including conductive members electrically connected to fluidic dies. Portions of the conductive members and the fluidic dies may be exposed to a fluid channel. Due to the electrical connection of the fluidic dies and the conductive members, an electrochemical cell may be formed between the conductive member, the fluidic die, and a fluid of the fluid channel. In some examples, formation of the electrochemical cell as described herein may reduce interaction of the fluid with the exposed surface of the fluidic die. In some examples, the electrochemical cell facilitated by examples described herein may reduce etching of exposed surfaces of the fluidic die.

The preceding description has been presented to illustrate and describe examples of the principles described. This description is not intended to be exhaustive or to limit these principles to any precise form disclosed. As used herein, "approximate" with regard to numerical values may indicate a range of ±10%. Moreover, while various examples are described herein, elements and/or combinations of elements may be combined and/or removed for various examples contemplated hereby. For example, the operations provided herein in the flowchart of FIG. 10 may be performed sequentially, concurrently, or in a different order. In addition, the components illustrated in the examples of FIGS. 1-9 may be added and/or removed from any of the other figures in any quantities. Many modifications and variations are possible in light of the description. Therefore, the foregoing examples provided in the figures and described herein should not be construed as limiting of the scope of the disclosure, which is defined in the Claims.

The invention claimed is:

1. A fluidic device comprising:

a fluidic die with a back surface;

a support element coupled to the fluidic die, the support element having a fluid channel formed therein, the fluid channel exposing at least a portion of the back surface of the fluidic die, the support element further having a member opening passing through the support element; and a conductive member connected to the fluidic die, the conductive member at least partially disposed in the member opening such that a portion of the conductive member is exposed to the fluid channel of the support element, wherein the conductive member is distanced from the fluidic die.

2. The fluidic device of claim 1, wherein the fluidic die includes a plurality of fluid ports formed through the back surface thereof such that the fluid channel of the support element is fluidically coupled to the fluid ports of the fluidic die, the fluidic device further comprising:

a cartridge housing coupled to the support element, the cartridge housing having a fluid reservoir disposed therein, the fluid reservoir fluidically connected to the fluid ports of the fluidic die via the fluid channel of the support element.

3. The fluidic device of claim 1, wherein the conductive member is electrically connected to a common ground with the fluidic die.

4. The fluidic device of claim 3, wherein the conductive member is to form an electrochemical cell with the fluidic die when in contact with fluid of the fluid channel.

5. The fluidic device of claim 1, wherein the back surface of the fluidic die has a first surface area that is exposed to the fluid channel, the conductive member has a second surface area that is exposed to the fluid channel, and the second surface area is greater than the first surface area.

6. The fluidic device of claim 1, wherein the fluidic die comprises a silicon substrate.

7. The fluidic device of claim 1, wherein the fluidic die includes at least one sensor element disposed on the back surface thereof.

8. The fluidic device of claim 1, wherein the fluidic die further includes:

a plurality of fluid ports formed through the back surface thereof, the plurality of fluid ports fluidically coupled to the fluid channel of the support element;

a plurality of fluid chambers formed in the fluidic die, the fluid chambers fluidically coupled to the fluid ports;

a plurality of nozzles formed through a top surface thereof, the plurality of nozzles fluidically coupled to the fluid chambers; and a plurality of fluid actuators, the plurality of fluid actuators disposed in the plurality of fluid chambers.

9. The fluidic device of claim 1, further comprising:

a conductive adhesive that adheres the conductive member to the support element and connects the conductive member to the fluidic die.

10. A fluidic device comprising:

a cartridge housing having a fluid channel formed therein, the cartridge housing further having a member opening passing therethrough;

a fluidic die coupled to the cartridge housing, the fluidic die having a plurality of fluid ports formed in a back surface thereof, at least a portion of the back surface of the fluidic die exposed to the fluid channel such that the fluid channel is fluidically coupled to the fluid ports;

a fluid reservoir disposed within the housing and fluidically coupled to the fluid channel such that the fluid reservoir supplies fluid to the fluidic die via the fluid channel and the fluid ports; and a conductive member electrically connected to the fluidic die and at least partially disposed in the member opening such that a portion of the conductive member is exposed to the fluid channel, wherein the conductive member is distanced from the fluidic die.

11. The fluidic device of claim 10, wherein the conductive member is electrically connected to a common ground with the fluidic die such that the conductive member, fluidic die, and fluid of the fluid channel form an electrochemical cell.

12. The fluidic device of claim 10, wherein the conductive member is formed of a core formed of a first material and an outer layer formed of a second material.

13. The fluidic device of claim 10, wherein the fluidic die further comprises:

a plurality of fluid chambers formed in the fluidic die, the fluid chambers fluidically coupled to the fluid ports;

a plurality of nozzles formed through a top surface thereof, the plurality of nozzles fluidically coupled to the fluid chambers; and a plurality of fluid actuators, the plurality of fluid actuators disposed in the plurality of fluid chambers.

14. A fluidic device comprising:

a plurality of fluidic dies;

a support element coupled to the plurality of fluidic dies, the support element having at least one fluid channel formed therein, the at least one fluid channel exposing at least a portion of a back surface of each fluidic die of the plurality of fluidic dies, the support element having at least one member opening formed therethrough; and at least one conductive member coupled to the support element and passing through the at least one member opening such that at least a portion of the at least one conductive member is exposed to the at least one fluid channel, the at least one conductive member connected to the plurality of fluidic dies, wherein the at least one conductive member is distanced from the plurality of fluidic dies.

15. The fluidic device of claim 14, wherein each fluidic die of the plurality comprises a silicon substrate, the at least one conductive member is connected to a common ground with each fluidic die such that the at least one conductive member and the plurality of fluidic dies are to form an electrochemical cell when in contact with fluid of the fluid channel.

* * * * *